United States Patent [19]

Kondo et al.

[11] Patent Number: 4,807,736

[45] Date of Patent: Feb. 28, 1989

[54] APPARATUS FOR DISCRIMINATING PAPER MONEYS AND STACKING THE SAME

[75] Inventors: Hiroatsu Kondo; Arihiko Iwasaki, both of Toyonaka, Japan

[73] Assignee: I.M. Electronics Co., Ltd., Japan

[21] Appl. No.: 817,587

[22] Filed: Jan. 10, 1986

[30] Foreign Application Priority Data

Jan. 7, 1986 [JP] Japan ..... 61-1921

[51] Int. Cl.[4] ..... G07F 7/04; B65H 29/44

[52] U.S. Cl. ..... 194/206; 271/181

[58] Field of Search ..... 194/206, 207; 271/177, 271/178, 179, 180, 181

[56] References Cited

U.S. PATENT DOCUMENTS

| | | | |
|---|---|---|---|
| 4,290,594 | 9/1981 | Ludemann et al. | 271/180 |
| 4,540,081 | 9/1985 | Mori et al. | 194/207 |
| 4,678,072 | 7/1987 | Kobayashi et al. | 194/206 |

FOREIGN PATENT DOCUMENTS

| | | | |
|---|---|---|---|
| 2453811 | 12/1980 | France | 194/207 |
| 54-110567 | 8/1979 | Japan | 271/181 |

*Primary Examiner*—F. J. Bartuska

*Attorney, Agent, or Firm*—Stevens, Davis, Miller & Mosher

[57] ABSTRACT

An apparatus for discriminating authenticity and denomination of paper money bills and stacking the same includes at the transfer passage through which the paper money bills are transferred in an unfolded condition guide pieces which form a pushing-in part which is adjacent the reverse face of the paper money. Sending-out elements are arranged ahead of the guide pieces. The sending-out elements are movably supported and include spaced apart moving pieces, such that when the sending-out elements turn, the moving pieces push the paper money bills into the stacker box and spread them out moving from a front portion of the transfer passage to a rear side of the guide pieces and pushing the pushing-in part while the distance between the moving pieces expands. This structure enables the apparatus to press the paper money into the stacker box and at the same time spread out the paper money. The guide pieces prevent the paper money bills which have been pressed into the stacker box from returning to the transfer passage.

5 Claims, 13 Drawing Sheets

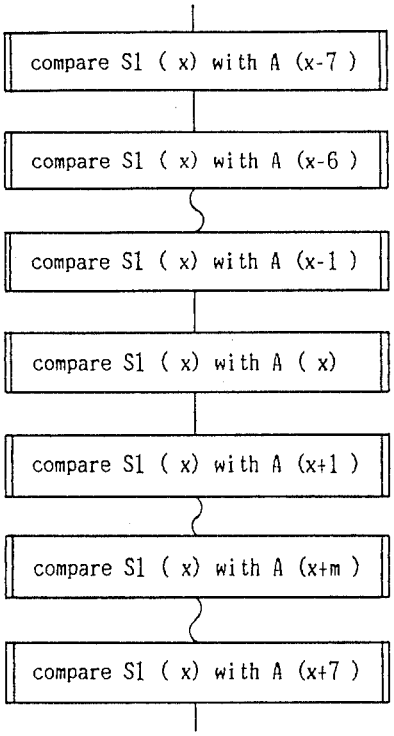
FIG. 14
FIG. 15
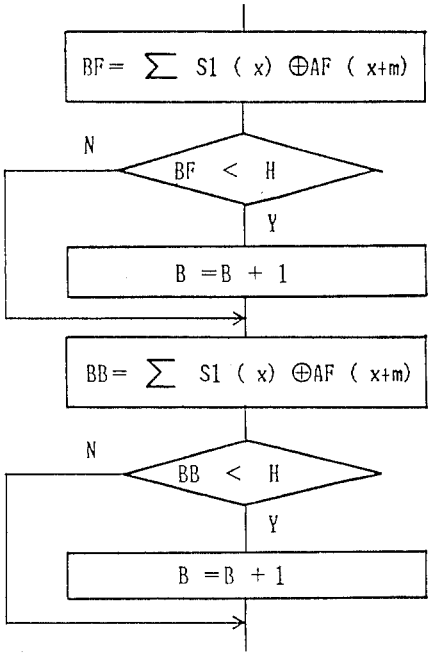

APPARATUS FOR DISCRIMINATING PAPER MONEYS AND STACKING THE SAME

BACKGROUND OF THE INVENTION

1. Field of the Invention

This invention relates to an apparatus for discriminating paper money and stacking the same which has the ability of discriminating the authenticity of the paper money and denominations thereof.

2. Prior Art

For automatic vending machines or bank paying-in devices, there is being used a kind of paper money-discriminating apparatus which discriminates the authenticity of paper money and denominations thereof and therewith receives the paper money being identified as genuine bills stacked one above another in order.

In such apparatus heretofore in use, paper money sent through the passage were pushed into the receiving box which was made open at its front face with a view to pushing in the paper money by using the pushing-in plate which was so designed as to undergo linear motion with the aid of intersecting links, whereas the backing of the paper money after having been pushed in would be prevented by a holding plate which leaped out from side to front of the paper money. Such being the case, such apparatus was complicated in structure and large-sized, thereby increasing the production cost of the apparatus.

SUMMARY OF THE INVENTION

It is the object of this invention to provide an apparatus for discriminating paper money and stacking the same which has the ability to solve the controversial points as mentioned above, namely, such an apparatus which is provided with sending-out fittings that push in the paper money into the stacker box by swinging from front to rear all the way to the rear of the guide pieces that guide both the sides of the paper money, and which is simple in structure and is able to stack the paper money one above another in order smoothly and surely.

BRIEF DESCRIPTION OF THE INVENTION

FIGS. 12 to 15 are explanatory diagrams describing the working of the same control circuit in FIG. 11.

DETAILED DESCRIPTION

Figure 1:
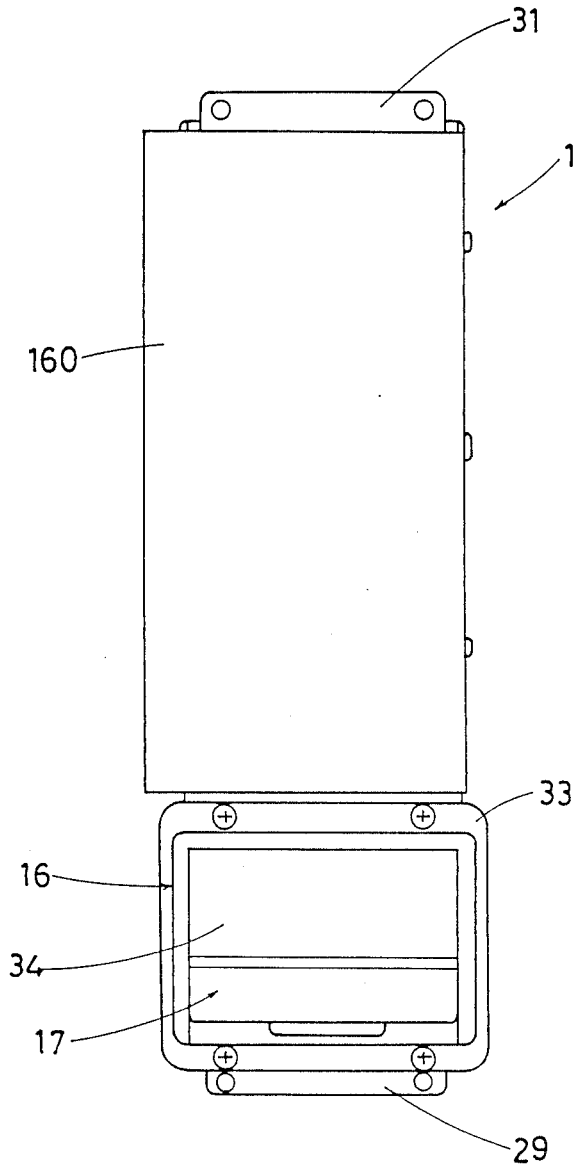
FIG. 1 is a front elevation showing an embodiment of this invention.

Taking the case of the apparatus for discriminating paper money bills and stacking the same according to the invention being formed as a constructional unit which is to be incorporated into various kinds of machines, such as, for example, an automatic vending machine, there will be now described an example of the present invention with reference to the appended drawings as follows:

The figures show an apparatus 1 for discriminating paper money and stacking the same. A base box 2 which has sensors 4, 4 for discriminating paper money B. Base box 2 includes passage 3 for transferring the paper money B in an unfolded state with guide pieces 5, 5 forming a pushing-in part 6 which guides both the side parts of the paper money B and allows the reverse face thereof to be exposed. A stacker box 7 is mounted on base box 2 and has a receiving plate 9 biased forward. Stacker box 7 is able to receive said paper money B. In front of the guide pieces 5, 5 are arranged the respective sending-out fittings 10, 10 having the respective moving pieces 11, 11 which push the paper money B into the stacker box 7 by turning the passage 3 from front to rear and that through the pushing-in part 6 in the back of the guide pieces 5, 5.

Figure 2:
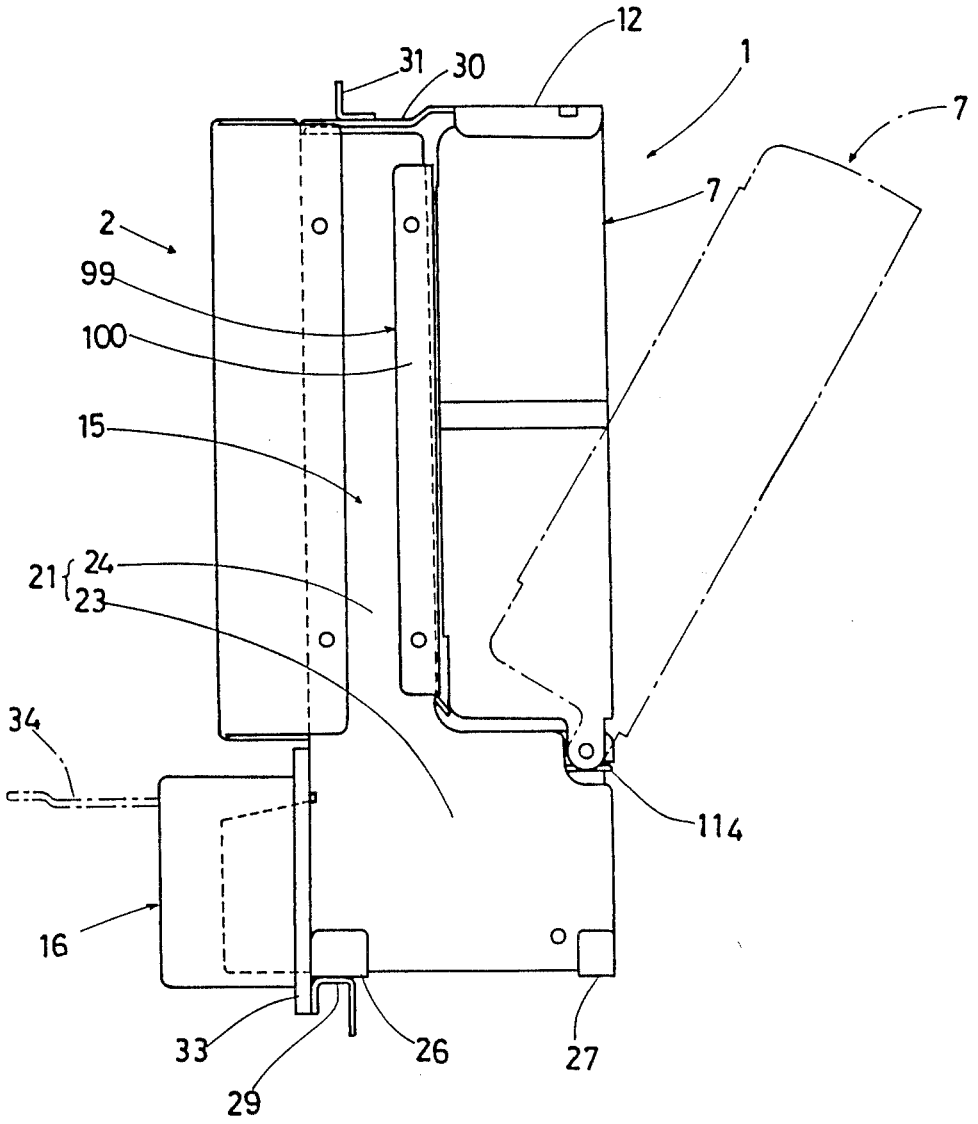
FIG. 2 is a side view of the FIG. 1 embodiment.

The base box 2 is furnished with an outer frame 15 and a front cover 16 attached to the lower end part of the outer frame 15, as shown in FIGS. 1 and 2.

The outer frame 15 has side plates 21, 21, each of which constitutes an inverted T-shape as a result of being made by erecting an upper plate part 24, narrow in breadth, on the middle part of a lower plate part 23, and also a front plate 25 joining the front ends of the above-mentioned upper plates 24, 24 together. At the lower ends of said side plates 21, 21, the joining pieces 26, 27 are spanned. There is fixed on the under face of the joining piece 26 a metal fitting 29 of J-shaped section. The front face of the metal fitting 29 is in line with the front face of the above-mentioned front plate 25. At the top end of the front plate 25, an upper plate 30 is formed by being folded. There is fitted on upper plate 30 a L-shaped metal fitting 31.

The front cover 16 takes the form of a square column surrounding the frontal part of the above-mentioned lower plate parts 23, 23, and is fixed by screwing a flange 33 which is formed on its own rear end part to both the above-mentioned metal fitting 29 and the front face of the above-mentioned front plate 25. At the opening part of the front cover 16, there is formed an inserting part 17 for inserting the paper money B, while at this inserting part 17 is arranged an opening and closing door 34 being able to be pushed open with freely.

Further, there are provided between the lower plates 23, 23 an upper block piece 39 and a lower block piece 40.

Figure 3:
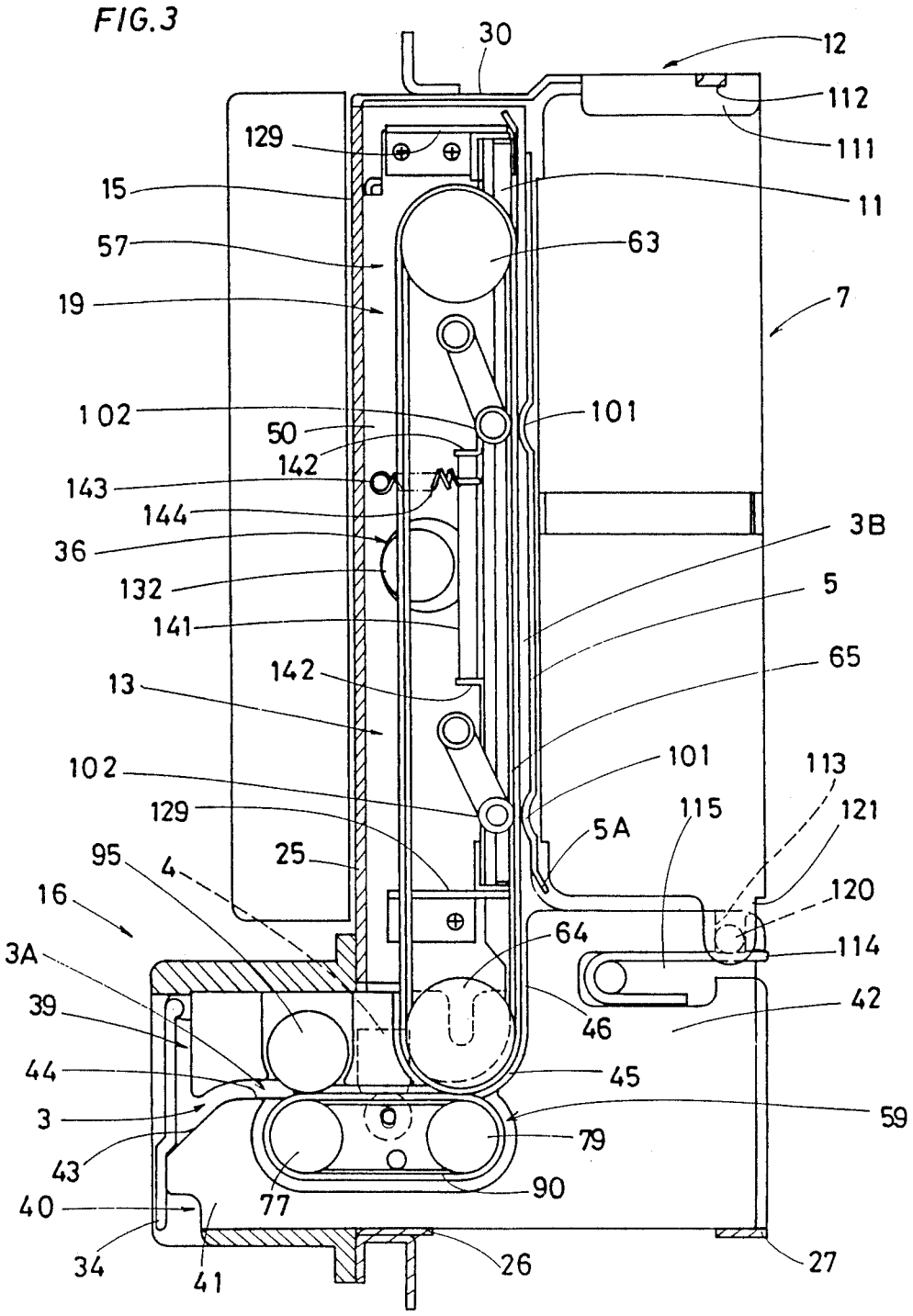
FIGS. 3 to 5 are vertical sections of the FIG. 1 embodiment.
Figure 4:
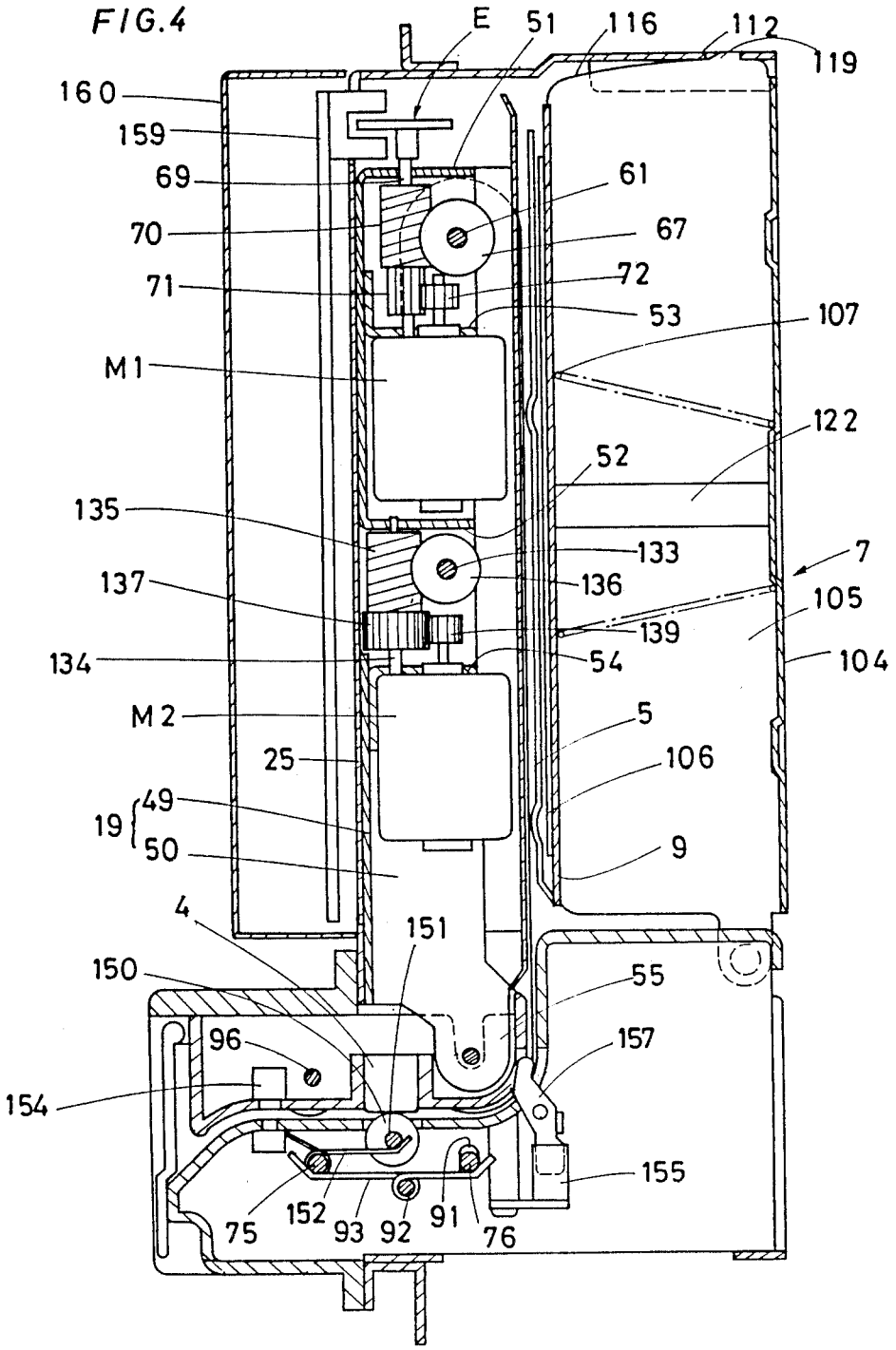
Figure 5:
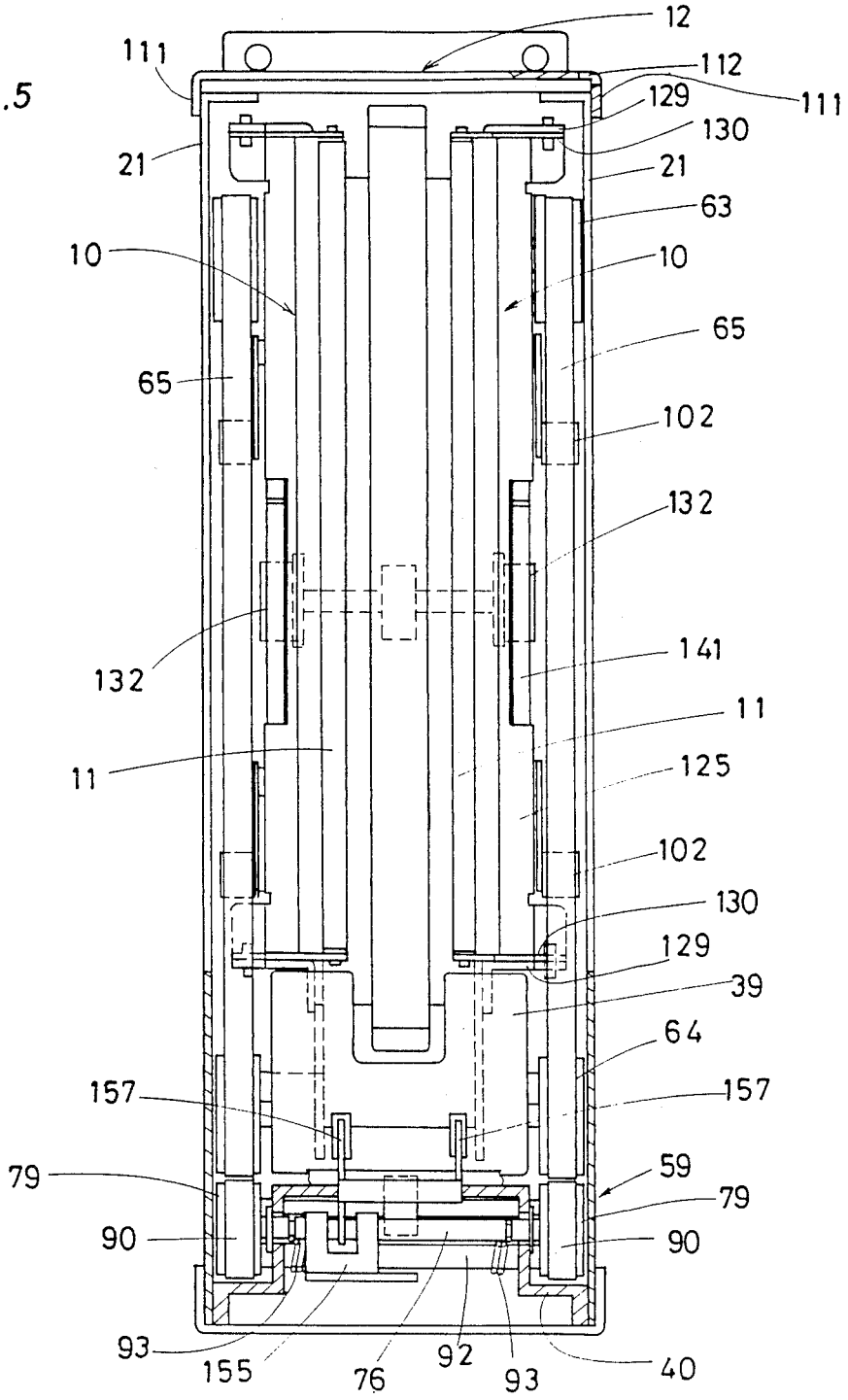

The lower block piece 40 erects a protruding part 42 on the rear verge of the basal part 41 having a size in depth approximately equal to that of the above-mentioned lower plate part 23, as shown in FIG. 3, while this lower block piece 40 takes the form of an L-shape when viewed from the side. The front end of the above-mentioned basal part 41 is inserted into the front cover 16 to impinge upon the lower end part of the above-mentioned opening and closing door 34. The top face of the basal part 41 is formed the rear end of its horizontal surface into the form of a smooth arcuate surface continuous to the vertical front fact of the protruding part 42, and at the front end into the form of a guide part 43 constituting an inclined plane sloping down forwardly.

The upper block piece 39 is arranged above the basal part 41 of the above-mentioned lower block piece 40, while the fore half part of the upper block piece 39 is inserted into the front cover 16. The upper block piece 39 and the lower block piece 40 face each other at an almost prescribed interval, and this interval constitutes the lower passage 3A through which the paper money B is transferred. In consequence, this lower passage 3A is provided from before in order with guide part 43, horizontal part 44, arcuate part 45, and vertical part 46. The upper and lower block pieces 39, 40 both are hollow within. The upper block piece 39 is open at its top surface, while the lower block piece 40 is open at its under and rear surfaces.

In the interior of the outer frame 15 is provided the inner frame 19. This inner frame 19 is of a U-shaped section being created by providing side plates 50, 50 at both side verges of the front plate 49 which is fixed fast on the above-mentioned front plate 25 of the outer frame 15. In the interior of the inner frame 19, there are provided supporting pieces 51, 52 which are formed by bending the upper end of the front plate 49 and the middle part thereof. Further, on the back face of the front plate 49, an L-shaped supporting fittings 53, 54 are fixed surely so as to confront the above-mentioned supporting pieces 51, 52, respectively. Also at the lower end of the side plates 50,50, there are provided the projecting pieces 55, 55 which are inserted in the rear end part of the above-mentioned upper block piece 39.

The base box 2 is provided at the rear end of its upper plate 30 with a latch 12. This latch 12 has at both side verges of the basal part of the same breadth as that of the outer frame 15 the side pieces 111, 111, at which there are provided engaging holes 112, 112 being formed by cutting away part of both side verges of the above-mentioned basal part.

On the other hand, in the base box 2, there is cut away L-shaped corner part lying above the rear end of the lower plate part 23 of the side plate 21 to expose thereby the side face of the lower block piece 40, and there are provided concavely at the exposed sides the engaging grooves 113, 113 extending upward and downward. Further, there is arranged at the lower end of the above-mentioned engaging groove 113 a receiving piece 114 consisting of a J-shaped plate spring which is housed in a concave part 115 being provided at the side face of the lower block piece 40 and which is encouraged upward.

There is provided at the above-mentioned base box 2 a transferring tool 13 for transferring the paper money B.

The transferring tool 13 consists of a primary transferring tool 57 which is arranged within the inner frame 19 and which is driven by a transferring motor M1, and a secondary transferring tool 59 which is arranged within the lower block piece 40 and which follows the above-mentioned primary transferring tool 57.

The primary transferring tool 57 fixes rotary bodies 63, 63, 64, 64 on both ends of supporting shafts 61, 62 passing through both the upper end part of the side plates 50, 50 and the projecting pieces 55, 55 by means of the upper and lower end parts of the inner frame 19. On the other hand, there are spanned between the rotary bodies 63, 64 the endless link cords 65, 65, such as, for example, a timing belt. A worm wheel 67 being adhered to the supporting shaft 61 engages with a worm gear 70 being fixed on the rotary shaft 69 which is spanned between the supporting piece 51 and the supporting fitting 53, while a toothed wheel 71 adhered to the rotary shaft 69 engages with another toothed wheel 72 attached to the rotary shaft of the transferring motor M1 which is mounted on the supporting fitting 53. Accordingly, the running-back line of the endless link belt 65 moves up and down in accordance with the forward and reverse motion of the transferring motor M1. By the way, the upper end of the rotary shaft 69 projects from the supporting piece 51, with a rotary encoder E being attached thereto.

The secondary transferring tool 59 is provided on both ends of the supporting shafts 75, 76 piercing through the basal part 41 of the lower block piece 40 with the rotary bodies 77, 77, 79, 79, nd there are spanned between the rotary bodies 77, 79 the endless link codes 90, 90 such as, for example, a timing belt. On the other hand, the supporting shafts 76, 76 can move up and down through the slots 91 . . . which are provided at each side piece of the lower block piece 40 and extends upward and downward. Between the above-mentioned side piece, there is spanned a supporting pin 92 at a point intermediate to two supporting shafts 75, 76. At both sides of the supporting pin 92, there are arranged the torsion springs which bias the supporting shafts 75, 76 upward.

Accordingly, the other rotary bodies 77, 79 also are biased upward. On the other hand, the secondary transferring tool 59 is provided additionally at its front end with the receiving rollers 95, 95. These receiving rollers 95, 95 are fixed on both ends of the supporting shaft 96 which penetrates through the frontal part of the upper block piece 39. The running-upward line of the secondary transferring tool 59 impinges against both the under face of the receiving roller 95 and the under face of the endless link cord 65 of the primary transferring tool 57. When impinging in this way, the running-up line of the secondary transferring tool 52 is situated in the middle part between the upper side and the lower side of the above-mentioned under passage 3A, while the running-back line of the primary transferring tool 57 is situated in the center of the vertical part 46 of the passage 3A. Accordingly, the secondary transferring tool 59 follows the primary transferring tool 57 to rotate while impinging upon the primary transferring tool 57.

Figure 6:
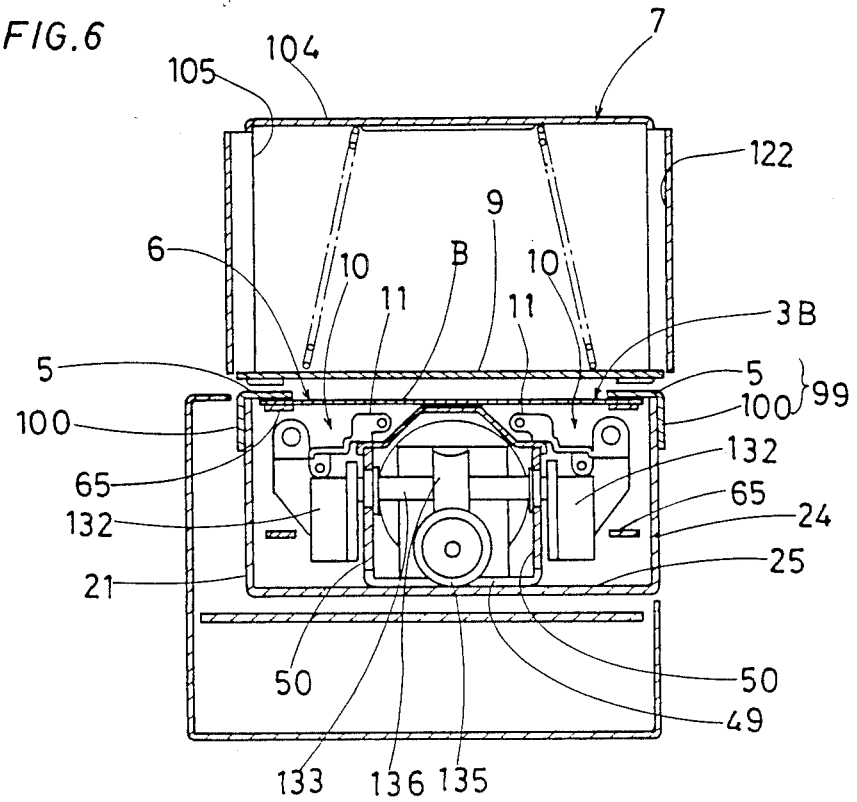
FIG. 6 is a cross-sectional view of the FIG. 1 embodiment.

There are attached to the side plate 21, 21 of the above-mentioned outer frame 15 the guide fittings 99, 99. These guide fittings 99, 99 have an L-shaped section, which is formed by attaching the inward guide pieces 5 rectangularly to the rear end of the fitting pieces 100 fixed on the rear end parts of the upper plate parts 24 of the side plates 21, 21, as shown in FIGS. 2, 3 and 6. The front faces of the guide pieces 5 stand opposite to the above-mentioned endless link cords 65, while there are formed at the nearly middle parts and the lower parts of the endless link cords 65 the circular arc-shaped projecting parts 101, 101. The endless link cords 65 are pressed slightly to the above-mentioned projecting parts 101, 101 by the push rollers 102, 102 provided at the side faces of the inner frame 19. At the lower ends of the guide pieces are formed the guide parts 5A which are bent rearward.

The space between the running-back line of the primary transferring tool 57 and the guide piece 5 constitutes the over passage 3B continuing to the upper end of the above-mentioned under passage 3A.

The above-mentioned passage 3 consists of these passages 3A, 3B. Accordingly, the guide pieces 5, 5 guide both the side parts of the paper money B to hold this paper money B vertically between themselves and the endless link cord 65.

Further, the guide pieces 5, 5 constitute the above-mentioned pushing-in part 6 which causes the reverse side of the above-mentioned paper money B to be exposed through the space between the inner ends of the guide pieces 5, 5.

There is attached with the freedom of loading and unloding to the base box 2 the stacker box 7 capable of receiving the above-mentioned paper money bills B stacked one above another by means of the above-mentioned latch 12 and the engaging grooves 113.

The stacker box 7 has a receiving plate 9 which is installed with the freedom of moving back and forth within the U-shaped basal part provided with one rear plate 104 and two side plates 105, 105. The rear plate 104 is of a rectangular flat plate body larger than the paper money B, at the upper end verge of which is provided a notched part 117 cut off in a U-shaped while the side plate 105 is provided at its upper verge with a pawl piece 119 which is engaged in the engaging hole 112 of the above-mentioned latch 12, on the one hand, and at the inner face of the lower verge, on the other hand, with the projecting piece 121 which is protuberantly installed with the engaging pin 120 being made to be inserted into the above-mentioned engaging groove 113. There is formed at the upper verge of the side plate 105 the guide part 116 consisting of the inclined surface sloping down forward, and there are concavely provided in the inner face of the side plates 105, 105 the continuous guiding grooves 122, 122 extending in the forward and backward direction. Into those guiding groove 122, 122 are inserted the projecting pieces 121, 121 which are formed protuberantly on both end verges of the above-mentioned receiving plate 9, whereby the receiving plate 9 is able to undergo back-and-forth movement without falling off. Further, the receiving plate 9 is biased forward by the spring 107 consisting of a coiled spring arranged between itself and the rear plate 104, and the supporting pieces 106, 106 impinging against both side verges of the forward biased receiving plate 9 are formed on both front verges of the side plates 105, 105. Additionally, the notched parts 117, 117 are provided also at the upper and lower verges of the receiving plate 9.

The stacker box 7 can be securely attached to the base box 2 by inserting the engaging pin 120 into the engaging groove 113, and by being made to swing forward to hitch the pawl piece 119 into the engaging hole 112, while the stacker box 7 can be detached by pressing down the receiving piece 114 opposingly and by throwing it down backward.

With such an attachment as mentioned above, the above-mentioned pushing-in part 6 is surrounded by the opening part which is formed at the front face of the stacker box 7 by the space between the supporting pieces 106, 106.

On the other hand, there are arranged in the passage 3 in front of the guide pieces 5, 5 the sending-out fittings 10, 10 which push the paper money B through the pushing-in part 6 into the stacker box 7 while holding the paper money B between itself and the above-mentioned receiving plate 9.

Figure 7:
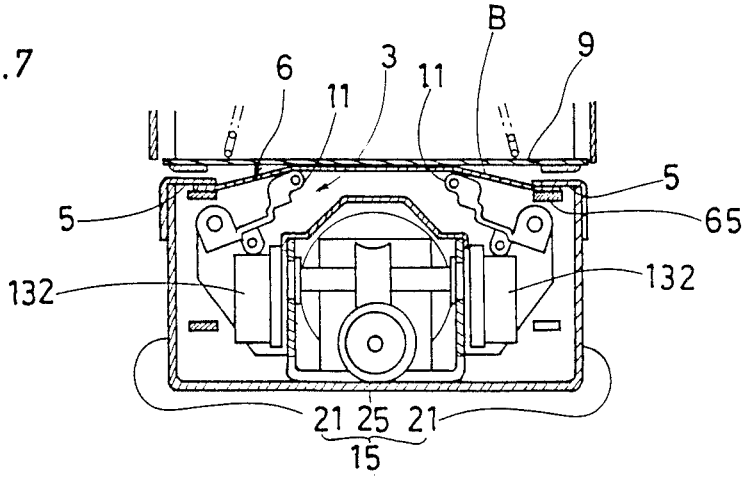
FIGS. 7 and 8 are cross-sectional views showing the working of the sending-out fittings.
Figure 8:
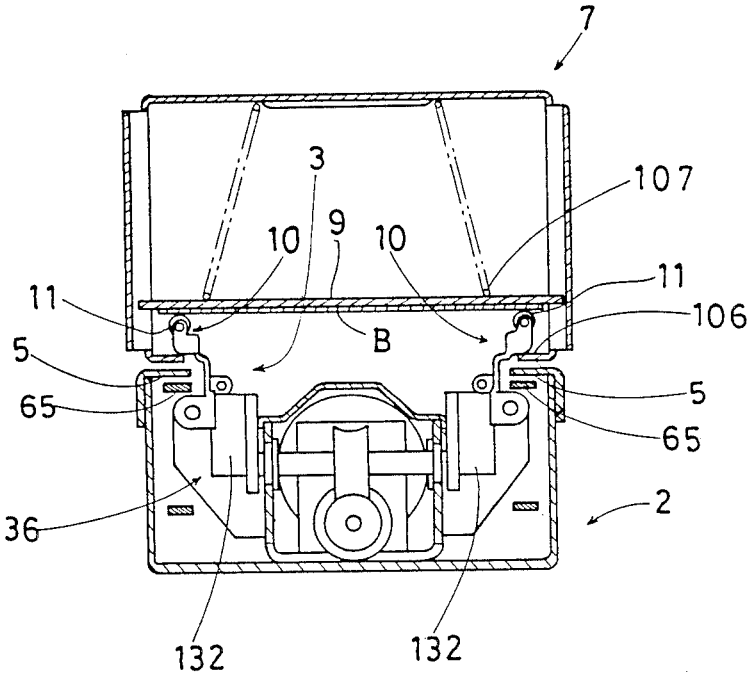
Figure 9:
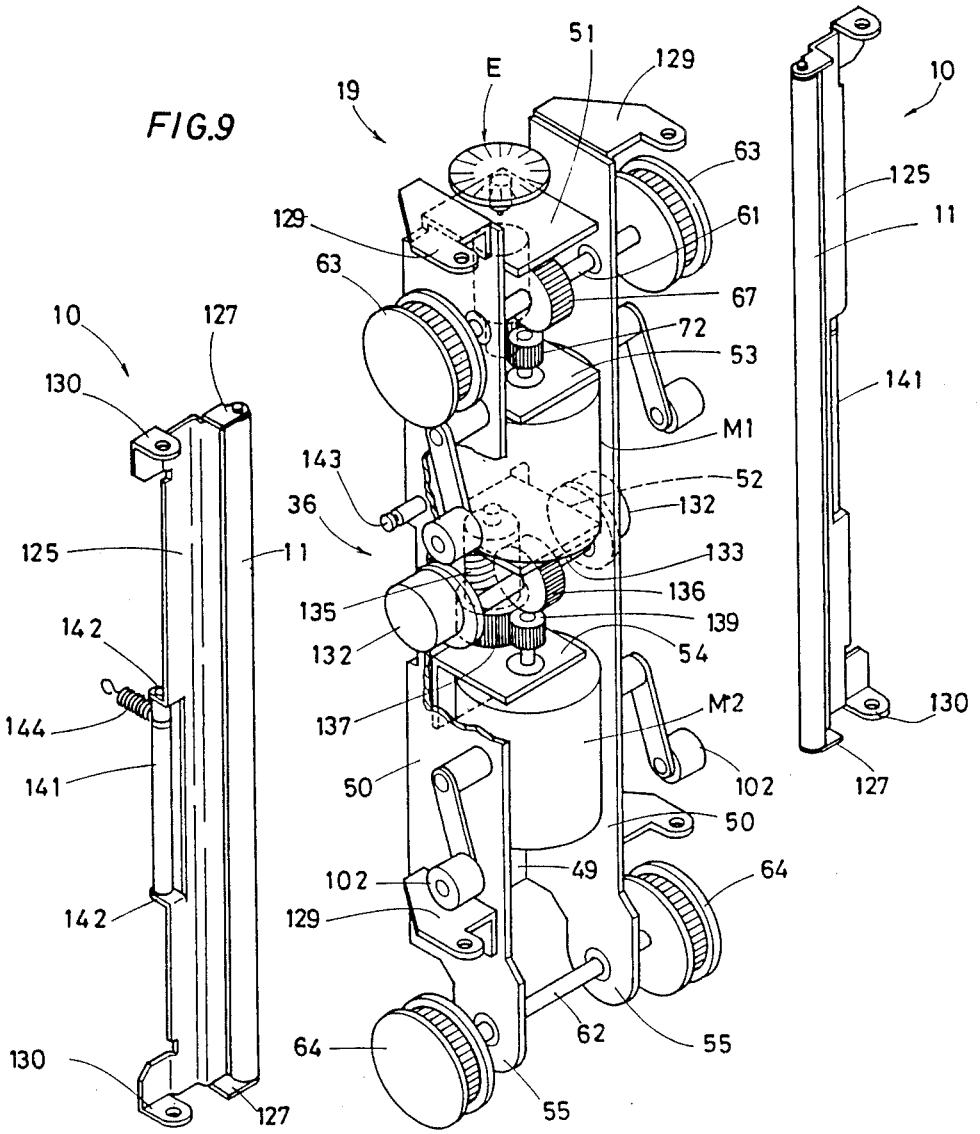
FIG. 9 is an exploded view in perspective of the principal part of the FIG. 1 embodiment.
Figure 10:
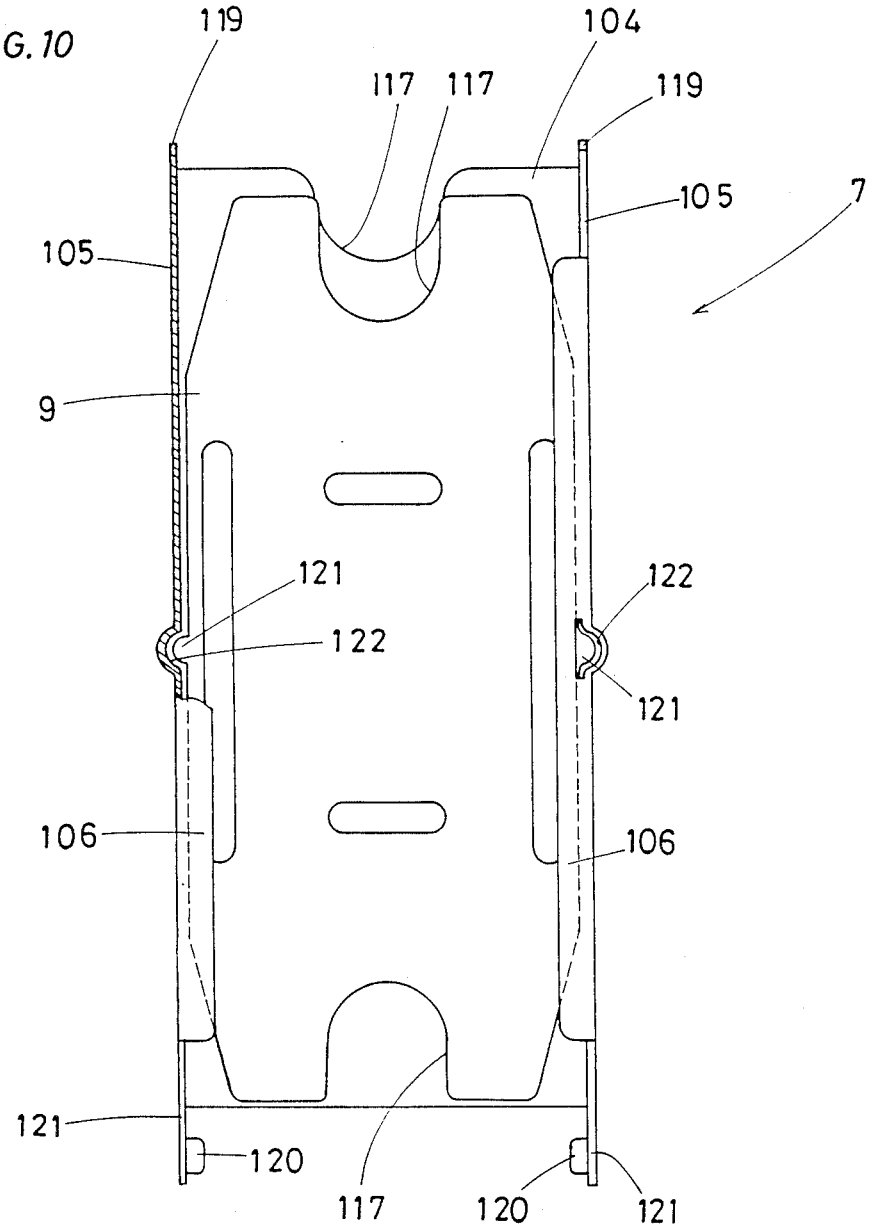
FIG. 10 is a front elevation showing a stacker box of the FIG. 1 embodiment.

As shown in FIG. 9, the sending-out fittings 10, 10 are so constructed wherein the above-mentioned moving pieces 11, 11 consisting of the long rollers which are arranged in parallel with the passage 3B are pivoted by the bearing pieces 127, 127 at the inner ends of the basal parts 125, 125 consisting of the bent pieces of the crank-shaped section; and at the outer ends of the basal parts 125, 125, there are provided protuberantly in a backward-directed position the projecting pieces 130, 130 supported by pins on the bearing fittings 129, 129 which are attached on the upper and lower parts of the side plate 50 of the above-mentioned inner frame 19. Accordingly, as shown in FIGS. 6 to 8, the sending-out fittings 10, 10 are able to swing around the pivoting points situated in the vicinity of both the side ends of the passage 3B, on the basis of which the moving pieces 11, 11 can swing throughout the passage 3B from front to rear, and that through the pushing-in part 6 toward the rear parts of the guide pieces 5, 5, and further until to the rear parts of the above-mentioned supporting pieces 106, 106 of the stacker box 7. On the other hand, there is provided at the inner frame 19 a swinging tool 36 for making the sending-out fittings 10, 10 swing.

The swinging tool 36 is made up of cams 132, 132 rotating by the actuation of the sending-out motor M2. These cams 132, 132 are adhered to both ends of the supporting shaft 133 which passes through the side plates 50, 50 of the inner frame 19. There is fixed on the supporting shaft 133 the worm wheel 136 engaging with the worm gear 135 which is fixed on the rotating shaft 134 spanned between the supporting pieces 52 and the supporting fitting 54, while there is fixed on the rotating shaft 134 the large toothed wheel 137 engaging with the small toothed wheel 139 which is attached to the rotating shaft of the sending-out motor M2. In this connection, this sending-out motor M2 is set up on the supporting fitting 54 with its rotating shaft being turned upward. There is attached on the above-mentioned sending-out fitting 10 the cam follower 141 impinging upon the cam 132.

This cam follower 141 is pin-shaped and is spanned between the supporting pieces 142, 142 which project to the front face of the basal part 125, while the spring 144 is spanned between the cam follower 141 and the supporting pin 143 projecting to the front verge part of the side plate 50, whereby the cam follower 141 is made to impinge against the cam 132.

With such an arrangement as described above, the sending-out fittings 10, 10 swing by the rotation ofthe cam 132, in company with which the moving pieces 11, 11 press the paper money B against the receiving plate 9 to hold that paper money B between itself and the receiving plate 9, as shown in FIG. 7. Further, as shown in FIG. 8, when the cam 132 rotates and the sending-out fittings 10, 10 swing at a maximum angle in a state in which cam 132 has made a half turn, then the moving pieces 11, 11 turn round the supporting pieces 106, 106 into the rear, as mentioned, while spreading both the side parts of the paper money B. Accordingly, the moving pieces 11, 11 push the paper money B through the above-mentioned pushing-in part 6 into the stacker box 7. When the cam 132 makes one further rotation, then the moving pieces 11, 11 swing in the reverse direction. At this time, the receiving plate 9 moves forward in company with the moving pieces 11, 11 to hold the paper money B between the receiving plate 9 and the supporting pieces 106, 106. As a result of that, the paper money B is received into the stacker box 7.

There is arranged in the above-mentioned passage 3 a sensor 4 for discriminating paper money B.

This sensor 4 is, in this embodiment, a magnetic head made up of a pair of magnetic resistance elements. This sensor 4 is mounted on the above-mentioned block piece 39, and is also additionally provided with the pinch roller 150. This pinch roller 150 is attached to the supporting shaft 151 which is spanned on the lower block piece 40 movably up and down and which is biased upward by the springs 152, 152 attached to the above-mentioned supporting shaft 75. With such an arrangement, the pinch roller 150 impinges slightly upon the sensor 4. Further, there is arranged at the front end of the passage 3A the detector 154 consisting of a photosensor which detects the insertion of the paper money B, while on the other hand there is arranged at the arcuate part 45 of the passage 3B the lever piece 157 which actuates the detector 155 by inclining when impinging against the paper money B, and which returns to the original position when the paper money B passes therethrough to prevent the paper money B from being pulled back.

Further, there is attached to the front face of the base box 2 the printed circuit board 159 constituting the control circuit CO. Printed circuit board 159 is extended over with the cover 160.

Incidentally, the control circuit CO identifies the authenticity and denominations of paper moneys by comparing and discriminating between the standard signals A and the pattern signals S1 received from the output of the sensor 4 which has read the identification pattern P printed on the paper money B by using magnetic ink.

Figure 11:
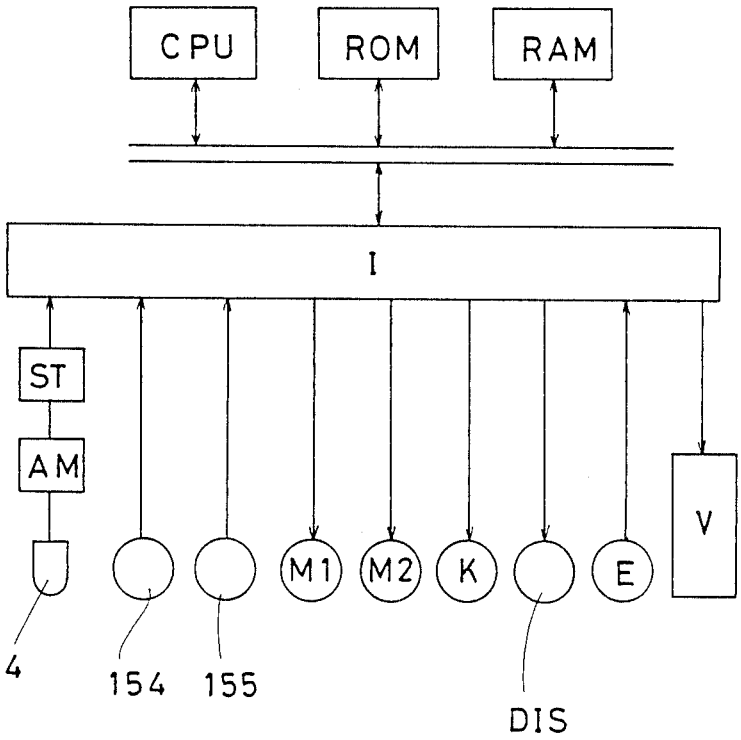
FIG. 11 is a block diagram showing a control circuit of the FIG. 1 embodiment.

As shown by the block diagram of FIG. 11, the above-mentioned control circuit CO is a microcomputer of a kind which is provided with a microprocessor CPU, RAM, ROM and the interface I. Each of the above-mentioned units is interconnected by means of a data bus, an address bus, and a control line, and is operated by a program previously stored within the ROM. The above-mentioned sensor 4 is connected to the interface I through an amplifying circuit AM and a waveform shaping circuit ST, while the detectors 154, 155, the rotary encoder E, the display part DIS, the transferring motor M1, the sending-out motor M2, and the alarm K are connected also to the same interface I.

Description will be now directed to the behavior of the above-mentioned control circuit CO with reference to FIGS. 12 to 15.

The control circuit CO detects the insertion of the paper money B through monitoring the output signal of the detector 154 and makes the transferring motor M1 rotate normally.

Subsequently, the transferring tool 13 feeds the paper money B into the passage 3, and the rotary encoder E outputs the timing signal S3 every 0.2 mm, in this example, on the printed surface of the paper money B, while the sensor 4 outputs the analog signal S4 including pulses P1–P9 of a relatively high level corresponding to the hem line 161, the portrait part 162, and the part with value declared 163. On the other hand, the waveform shaping circuit ST consisting of, for example, a Schmidt trigger circuit outputs the digital signal S5 which is the above-mentioned analog signal S4 being standardized on a certain fixed threshold level L. Each of these signals S3, S4, and S5 is added to the input port of the interface I.

Figure 12:
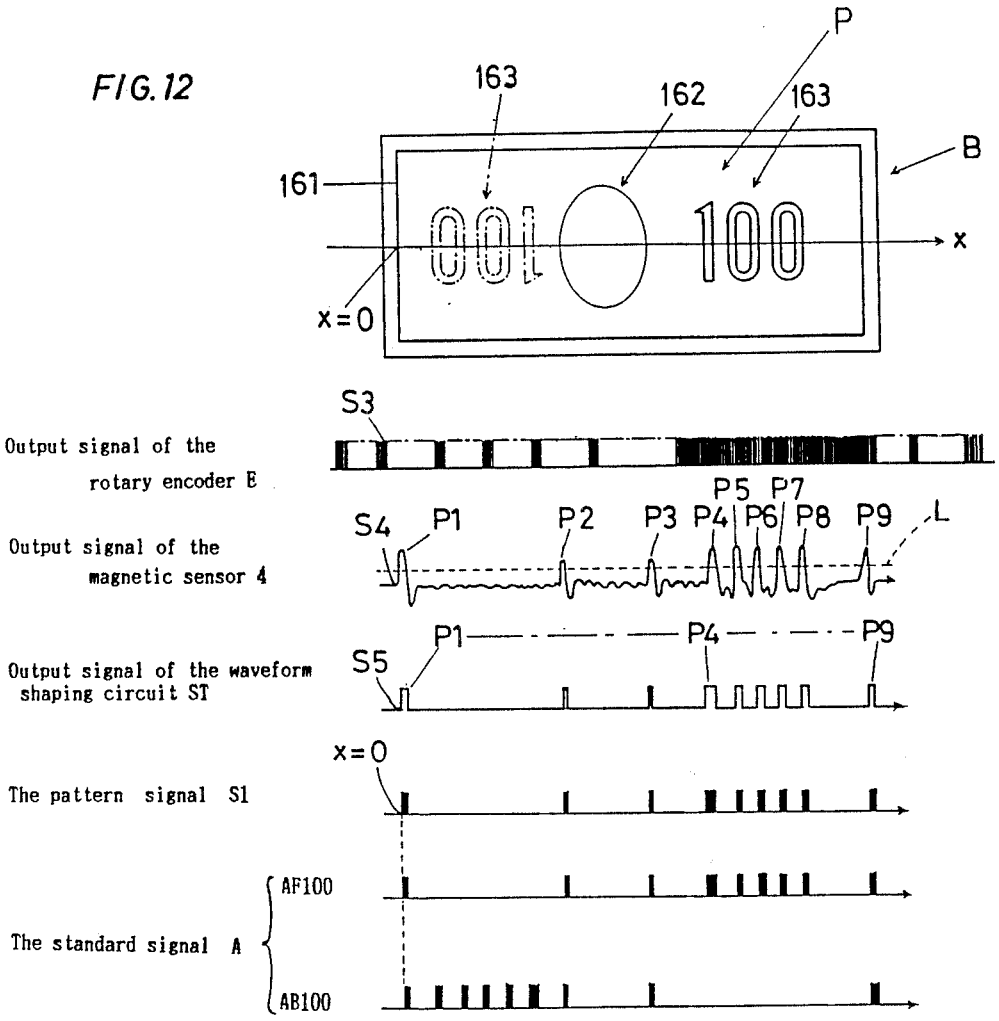
Figure 13:
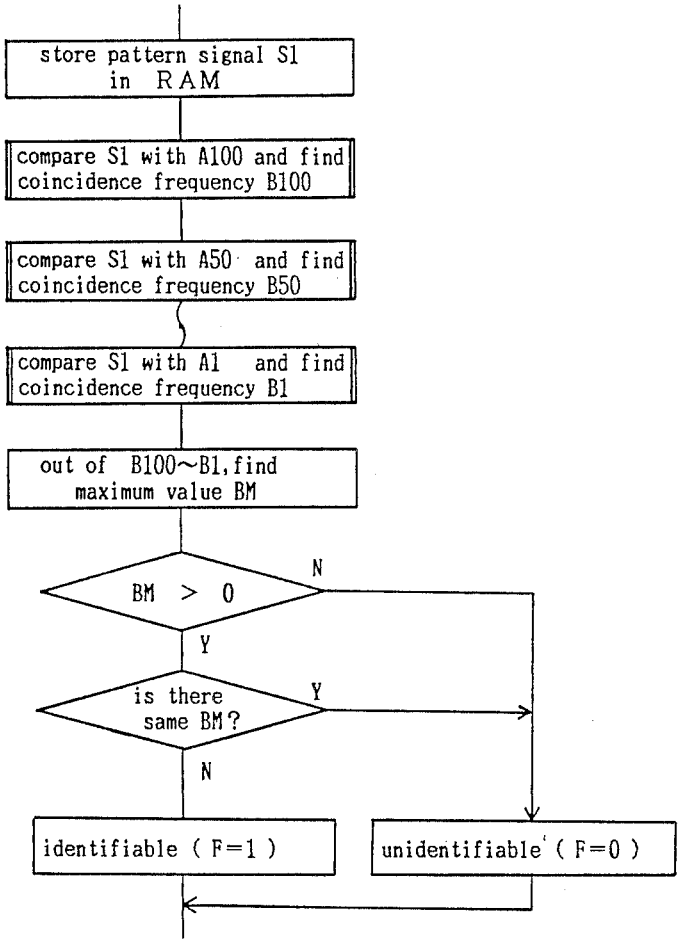

As shown in FIG. 12 and FIG. 13, the control circuit CO stores in the RAM the digital signal S5 which is sampled at an interval of the above-mentioned timing signal S3 while treating the pulse P1 of the very digital signal S5 of the wave form shaping circuit ST as a trigger signal. When viewed in this manner, the above-mentioned pattern signal S1 in this embodiment is none other than a signal sampled at an interval of 0.2 mm regarding the hem line 161, that is, the reference position as the starting point on the paper money B from the digital signal S5 which is the analog signal S4 of the sensor 4 standardized on a certain fixed threshold level L on the basis of the timing signal S3 of the rotary encoder E.

As for the above-mentioned standard signal A, it includes, for example, the standard signal A100 which is extracted from the 100-dollar bill among a large number of genuine bills in every denomination and is standardized by the same method as that by which the above-mentioned pattern signal S1 has been obtained, and similarly includes the standard signals A50, A20, A10, A5, A2, and A1 which are extracted from the 50, 20, 10, 5, 2, and 1-dollar bill, and is stored retrievably in the ROM.

Further, the control circuit CO compares via microprocessor CPU each of the bit patterns of the patterns signal S1 being stored in the RAM with each of the bit patterns of the standard signal A100, and counts the coincidence frequency B100 of those bits, and then compares similarly the pattern signal S1 with the standard signals A50–A1 and finds the coincidence frequency B50–B1 of them, respectively.

Subsequently, only when finding the maximum value BM out of the coincidence frequency B100–B1 and establishing that the very maximum value BM is positive and there is not any other one attaining the same maximum value BM, that maximum value BM is regarded as identifiable, let us say, its flag F is marked with 1 (one), while all others except the above are disregarded as unidentifiable, and flag F is marked with 0 (zero).

Description will be now directed to the behavior of the control circuit CO which compares the pattern signal S1 with the standard signal A, and thereby tries to find the coincidence frequency B of the both with reference to FIGS. 14 and 15.

At this time, it is supposed that the x th bit patterns of both the pattern signal S and the standard signal A are expressed as S1(x) and as A(x), respectively, and the above-mentioned reference position is expressed as $x=0$.

There is performed by the microprocessor CPU a comparison of the bit pattern S1(x) of the pattern signal S1 fetched from the RAM with the bit pattern $A(x+m)$ of the standard signal A fetched from the ROM.

In this example, when the value of the aforesaid m attains $-7$, to $+7$, the comparison is done by distinction at the two positions: the one is a position in which the respective reference positions of the pattern signal S1 and the standard signal A coincide each with other, that is, in which $m=0$; and the other is a position in which the above-mentioned reference positions are made to slide sideways relative to each other by a small interval (in this example, by 0.2 mm).

FIG. 15 is a flow chart exemplifying the motion of comparing the above-mentioned two bit patterns S1(x) and $A(x+m)$ in the microprocessor CPU.

The above-mentioned standard signal A in this embodiment is endowed with the normally directed standard signal AF and the reversely directed standard signal AB in regard to every denomination of the dollar bills, wherefore the control circuit CO is able to identify the paper money B in spite of its inserting direction.

First, the microprocessor CPU calculates the exclusive OR of each of the bit patterns S1(x) of the standard signal S1 and each of the bit patterns $AF(x+m)$ of the above-mentioned normally directed standard signal AF, and treats the total of it as the incoincidence frequency BF. Secondly, when the above-mentioned incoincidence frequency BF is below a predetermined fixed decision value H, it is decided that the pattern signal S1 coincides with the standard signal AF, adding 1 (one) to that coincidence frequency B, but when being above the decision value H, it is decided to be incoincident. Thirdly, the exclusive OR of the above-mentioned bit pattern S1(x) and the bit pattern AB(x+m) of the above-mentioned reversely directed standard signal AB is calculated, and the total of it is treated as the incoincidence frequency BB in the reverse direction, and when that incoincidence frequency BB is below the decision value H, 1 (one) is added to the above-mentioned operation coincidence frequency B.

In accordance with the above-mentioned, the control circuit CO is able to make the identification of the authenticity and denomination no matter whether the inserting direction of the paper money B is normal or reverse.

The control circuit CO compares the above-mentioned pattern signal S1 with the standard signal A while distinguishing them in the position where the above-mentioned reference positions are made to coincide each with other and in the position where those reference positions are made to slide sideways each to other by a small interval, in this example by 0.2 mm, on the paper money B. Therefore, the control circuit CO is able to discriminate with precision the identification pattern P even when a shift occurs in the feeding direction of the paper money B or a tilt occurs within the passage 3.

The display part DIS indicates the grand total amount of money.

In operation paper money B inserted into the passage 3 covers the detector 154 to drive the transferring motor M1. Therefore, the paper money B is sent into the inside of the passage 3 by means of the primary transferring tool 57 and passes beneath the sensor 4, when the sensor 4 reads the identification pattern P printed on the paper money B, as described before, and discriminates the authenticity of the paper money B and the denomination thereof. The paper money B identified as a genuine bill is guided by the primary transferring tool 57 to the inside of the passage 3B and stops thereat. Then the paper money B is held at both its side parts between the primary transferring tool 57 and the guide pieces 5, 5, when the reverse face of the paper money B is exposed by the pushing-in part 6. On the other hand, the primary transferring tool 57 comes to a stop, at the same time the swinging tools 36, 36 actuate, while the sending-out fittings 10, 10 let the paper money B pass through the pushing-in part 6 and then push it into the stacker box 7.

The control circuit CO detects through the detector 155 that the rear end of the paper money B has passed the lever pieces 157, 157, and delivers what is called a vend signal to the apparatus V, for example an automatic vending machine, whereby the apparatus V puts out moneys or goods.

When the paper money B is identified as spurious, the transferring motor M1 goes into servo to send back that paper money B toward inserting port 17, when the alarm K is actuated to give a warning signal.

Because the before-mentioned moving pieces 11, 11 are rotatable, they have the ability to send out the paper money B smoothly. Further, these moving pieces 11, 11 move from the middle part of the paper money B toward both side parts thereof, whereby the moving pieces 11, 11 are able to press even bills such as worn-out paper money B against the receiving plate 9 while spreading it out surely, as a result of which the paper money B can be received into the stacker box 7 stacked one above another in good order without bringing about a slightly folded condition.

Further, the stacker box 7 can be easily detached in a state where the paper money bills B are received within it as it stands while only being pressed down and swung back, thereby enabling the esy collection of the paper money B. Further, the stacker box 7 is able to increase the adaptability of itself to apparatus B of various kinds, for example, an automatic vending machine, by providing for a plurality of stacker boxes 7 different in number of paper money bills B to be received.

Furthermore, in the apparatus 1 for discriminating paper money and stacking the same according to the invention, it is possible to use, in place of the sensor 4, a magnetic sensor or a photosensor depending on the discrimination method used for the paper money. The transferring tool 13 is also possible to be composed of a single transferring tool without using two transferring tools, the primary 57 and the secondary 59, as in this embodiment. It does not matter if the transferring tool 13 would be formed by a set of a driving roller and a counter roller without using the endless link cord as in here. It is also possible for the swinging tool 36 to use means such as a gear or a link, save one using a cam, even if being able to swing the moving piece 11. The apparatus for discrminating paper money and stacking the same according to the invention is able to be modified into various sorts of embodiments, by way of example, an element formed so as to be able to discharge the paper money B identified as spurious to the other end of the passage 3.

As described above, the apparatus for discriminating paper money and stacking the same according to the invention is constructed such that there are arranged at the passage through which the paper money bills are transferred in a state of being unfolded the guide pieces forming the pushing-in which causes the reverse face of the paper money to be exposed. There are arranged ahead of the above-mentioned guide pieces the sending-out fittings which push the above-mentioned paper money into the stacker box by turning the above-mentioned passage from front through the above-mentioned pushing-in part in the rear of the guide pieces. As a result it is possible for this apparatus to press the paper money into the stacker box while spreading out the paper money, and, even in the case of worn-out paper money which is fragile, the apparatus is able, to stack them with good accuracy without causing them to be folded one over another. The guide pieces prevent the return of the paper money bills which have been pressed into the stacker box, so that they do not require the provision of any kind of holding plate advancing to the front of the paper money, as in conventional devices, on the basis of which they have many advantages such as, for example, being useful for lowering the cost of the apparatus or miniaturizing the machine size.

We claim:

1. An apparatus for discriminating authenticity and denomination of paper money bills and stacking the same, comprising:

(a) a base box;

(b) sensor means in said base box for discriminating said paper money bills;

(c) a passage in said base box including a first part for transferring paper money bills inserted therein past said sensor means and a pushing-in part disposed to receive said paper money bills from said first part;

(d) a pair of guide members disposed on one side of said pushing-in part of said passage and extending along a longitudinal direction of said pushing-in part, such that opposed inner edges of said guide members are spaced apart from each other in a transverse direction of said pushing-in part of said passage by a distance adapted to be less than a width of said paper money bills in said transverse direction when said paper money bills are being transferred through said passage;

(e) a stacker box mounted on said base box and having an opening positioned on said one side of said pushing-in part of said passage;

(f) a receiving plate disposed in said stacker box;

(g) means for biasing said receiving plate toward said opening in said stacker box;

(h) pushing means disposed in said base box, said pushing means including:

(i) a pair of parallel moving pieces disposed adjacent said pushing-in part and extending along said longitudinal direction of said pushing-in part, (ii) a pair of swing members arranged symmetrically relative to said transverse direction, an outer end part of each swing member being pivotably connected to said base box to provide a pivot located on said one side of said pushing-in part, said swing members having respective inner ends connected to said moving pieces, respectively, such that said moving pieces are movably supported to said inner ends of said swing members, and (iii) turning means for synchronously turning said swing members toward and away from said pushing-in part, whereby said swing members are turned forwardly by said turning means, said moving pieces are moved between said opposed inner edges of said guide members from a position on one side of said guide members to a position on the other side of said guide members while pushing one of said paper money bills between said opposed inner edges of said guide members such that one of said paper money bills transferred to said pushing-in part is pushed out therefrom onto said receiving plate;

(i) a distance between outer edges of said moving pieces in said transverse direction increasing while said moving pieces are being moved between said opposed inner edges of said guide members from a position on said one side of said guide members to said position on said other side of said guide members; and (j) said distance between said outer edges of said moving pieces having a maximum when said swing members are pivoted to an extreme position with said moving pieces disposed on said other side of said guide members, said maximum being greater than said distance between said oppositely disposed inner edges of said guide members, whereby said one of said paper money bills pressed onto said receiving plate is spread out by said moving pieces.

2. The apparatus of claim 1, wherein said stacker box is detachable from said base box.

3. The apparatus of claim 2, wherein said guide members are provided on said detachable stacker box, whereby the stacked paper money bills are supported between said guide members and said receiving plate.

4. The apparatus of claim 1, wherein said moving pieces each comprise a roller.

5. The apparatus of claim 1, wherein said pushing-in part of said passage is disposed to receive said paper money bills in an unfolded condition from said first part.

* * * * *